US007585265B2

(12) United States Patent
Gebhardt et al.

(10) Patent No.: US 7,585,265 B2
(45) Date of Patent: Sep. 8, 2009

(54) FAN-FOLDING MECHANISM FOR A CASE ERECTOR

(75) Inventors: Wayne Al Gebhardt, Spokane, WA (US); Derick Charles Baker, Liberty Lake, WA (US); Christopher Carl Eickstadt, Spokane, WA (US); Douglas Alan Boozer, Greenacres, WA (US); Troy Scott, Spokane, WA (US)

(73) Assignee: Frito-Lay North America, Inc., Plano, TX (US)

( * ) Notice: Subject to any disclaimer, the term of this patent is extended or adjusted under 35 U.S.C. 154(b) by 0 days.

(21) Appl. No.: 11/749,026

(22) Filed: May 15, 2007

(65) Prior Publication Data

US 2007/0293383 A1 Dec. 20, 2007

Related U.S. Application Data

(60) Provisional application No. 60/803,537, filed on May 31, 2006, provisional application No. 60/747,269, filed on May 15, 2006.

(51) Int. Cl.
*B31B 1/48* (2006.01)

(52) U.S. Cl. ..... 493/70; 493/80; 493/183; 53/491

(58) Field of Classification Search ..... 493/70, 493/80, 136, 183, 162; 53/484, 491
See application file for complete search history.

(56) References Cited

U.S. PATENT DOCUMENTS 1,058,522 A 4/1913 Auchu
1,123,976 A 1/1915 Auchu
2,289,820 A 7/1942 Ardell
3,323,283 A 6/1967 Johnson, Jr. et al.
3,452,653 A 7/1969 Berney
4,018,143 A 4/1977 Dice, Jr. et al.
4,061,081 A 12/1977 Pinto et al.
4,133,254 A 1/1979 Odom et al.
4,579,551 A 4/1986 Ulrich et al.
4,854,930 A 8/1989 Miselli et al.
4,857,038 A 8/1989 Tacchini
4,892,513 A 1/1990 Kwiek (Continued)

OTHER PUBLICATIONS

U.S. Appl. No. 60/803,537, filed May 31, 2006, Gebhardt et al.

(Continued)

*Primary Examiner*—Christopher Harmon
(74) *Attorney, Agent, or Firm*—Haynes and Boone, LLP

(57) ABSTRACT

Several implementations of a fan folding mechanism for folding flaps of a case into a fan fold arrangement are disclosed and described. In one implementation, the fan folding mechanism comprises four shoes, arranged to allow one shoe to contact a flap on each of four sides of the case. A finger, carried by each of the four shoes is configured for movement between a retracted position and an extended position, such that in the retracted position, each finger is in contact with a leading corner of a different flap of the case and the flaps are in an open position and in the extended position, each finger is in contact with the same leading corner of the same flap, and the flap is in the closed position. Four suction cups, each configured for releasable attachment to a trailing corner of a flap, may inhibit contention between flaps.

8 Claims, 12 Drawing Sheets

U.S. PATENT DOCUMENTS

| | | | |
|---|---|---|---|
| 4,917,663 | A | 4/1990 | Pazdernik |
| 5,066,269 | A | 11/1991 | Center et al. |
| 5,102,382 | A | 4/1992 | Center et al. |
| 5,102,385 | A | 4/1992 | Calvert |
| 5,106,359 | A | 4/1992 | Lott |
| 5,112,288 | A | 5/1992 | Ulrich et al. |
| 5,120,293 | A | 6/1992 | Franklin |
| 5,207,630 | A | 5/1993 | Decker et al. |
| 5,352,178 | A | 10/1994 | Pazdernik |
| 5,411,464 | A | 5/1995 | Calvert et al. |
| 5,445,590 | A | 8/1995 | Pazdernik |
| 5,456,570 | A | 10/1995 | Davis et al. |
| 5,558,614 | A | 9/1996 | Anderson et al. |
| 5,704,196 | A | 1/1998 | Pazdernik et al. |
| 5,897,480 | A | 4/1999 | Pazdernik |
| 6,837,664 | B2 | 1/2005 | Blakesley et al. |
| 7,156,607 | B2 | 1/2007 | Anderson et al. |
| 2004/0047715 | A1 | 3/2004 | Blakesley et al. |
| 2005/0074321 | A1 | 4/2005 | Anderson et al. |
| 2006/0182613 | A1 | 8/2006 | Anderson et al. |

OTHER PUBLICATIONS

U.S. Appl. No. 60/747,269, filed May 15, 2006, Gebhardt et al.

FAN-FOLDING MECHANISM FOR A CASE ERECTOR

RELATED APPLICATIONS

This patent application claims priority to provisional U.S. patent application Ser. No. 60/747,269, titled "Case Erector with Fan Folding Mechanism", filed on May 15, 2006, commonly assigned herewith, and hereby incorporated by reference.

This patent application claims priority to provisional U.S. patent application Ser. No. 60/803,537, titled "Case Erector with Fan Folding Mechanism", filed on May 31, 2006, commonly assigned herewith, and hereby incorporated by reference.

BACKGROUND

Case erectors and case sealers are automated machines that open and seal "cases," which in some applications are cardboard boxes. For example, cardboard boxes can be purchase new, or obtained for reuse, in a "knocked down" (i.e. a folded flat) configuration. The case erector opens the box so that product (e.g. goods and merchandise) may be inserted. A case sealer then seals the case (e.g. the case sealer applies tape or glue to flaps of the box).

In one application, a case sealer can close flaps of a cardboard or similar case in a "fan fold" configuration. A typical case or box has four flaps that comprise either (or both) the top and bottom of the box. Either or both of the top and the bottom flaps can be closed in a fan fold manner. Each flap is attached to the box along a fold. Each flap has an edge that is opposite the fold. The opposite edge has a left corner and a right corner. When the box is closed in a fan fold manner, the right corner of each flap is under the left corner of the adjacent flap to the right, or the left corner of each flap is under the right corner of the adjacent flap to the left. Thus, a fan fold configuration holds the flaps of a box closed without tape or glue. It is probably the case that the term "fan fold" derives from the resemblance of the flaps of the case, once folded, to resemble the blades of a air-moving fan, in that each flap is somewhat tilted in relation to other flaps.

SUMMARY

Several example implementations of a fan folding mechanism for folding flaps of a case into a fan fold arrangement are disclosed and described. In one implementation, the fan folding mechanism comprises four shoes, arranged to allow one shoe and an associated finger to contact a flap on each of four sides of the case. Each finger is configured to rotate 90 degrees, between a retracted position and an extended position. In the retracted position, each finger is in contact with a leading corner of a different flap of the case and the flaps are in an open position. In the extended position, each finger is in contact with the same leading corner of the same flap, and the flap is in the closed position. Four trailing corner retention devices, such as suction cups are configured for releasable attachment to a trailing corner of each flap, to prevent contention between the leading corner of one flap and the trailing corner of an adjacent flap as the flaps close.

This Summary is provided to introduce a selection of concepts in a simplified form that are further described below in the Detailed Description. This Summary is not intended to identify key features or essential features of the claimed subject matter, nor is it intended for use as an aid in determining the scope of the claimed subject matter.

BRIEF DESCRIPTION OF THE DRAWINGS

The detailed description is described with reference to the accompanying figures. The use of the same reference numbers in different figures indicates similar or identical items.

DETAILED DESCRIPTION

Overview

The following discussion is directed to several example implementations of fan folding mechanisms, wherein each is configured to fold flaps of a case into a fan fold arrangement. When closed in a fan-fold manner, the flaps of a case, e.g. a cardboard box, are typically arranged, without tape or glue, by folding each flap under the flap to one side and over the flap to the other side. This arrangement is consistent for all four flaps. The corner or side of each flap that is under a corner of an adjacent flap, and is termed the "leading corner" (or leading side) since it was closed before the "trailing" corner which covers it. Additionally, each flap has a trailing corner (or trailing side) that covers the leading corner of an adjacent flap. The "trailing corners" are therefore closed incrementally (i.e. very shortly) after the "leading corners" are closed.

In one example implementation, the fan folding mechanism comprises four "shoes," arranged to allow one shoe to contact the leading corner of each of the four flaps of the case. A "finger," carried by each of the four shoes is configured for movement through approximately 90 degrees, between a retracted position and an extended position. In the retracted position, each finger is in contact with a leading corner of a different flap of the case and the flaps are in an open position. In the extended position, each finger is in contact with the same leading corner of the same flap, and the flap is in the closed position. To require the trailing corner to close after the leading corner of an adjacent flap, and to prevent contention between adjacent flaps as they close, the trailing corner of each flap may be restrained from movement just long enough to allow the leading corner to move past the trailing corner. The restraint may be provided by a trailing corner retention device, such as a suction cup, mechanical arm, or similar structure. For example, the suction cup may resist movement of the trailing corner of a first flap until after the leading corner of a second flap, adjacent to the first flap, has moved sufficiently to prevent contention between the leading and trailing corners. After the flaps are closed, a "discharge pan" or supporting bar can be moved into a case-bottom supporting position. Simultaneously or thereafter, the extended fingers can be removed from a position between the leading corner of one flap and the trailing corner of an adjacent flap by rotation of each finger's associated shoe. The finger of each shoe may be returned to the retracted position. Thus, this example implementation of the fan-folding mechanism technology discussed herein is able to close flaps of a case in a fan-fold manner.

First Example Implementation

Figure 1:
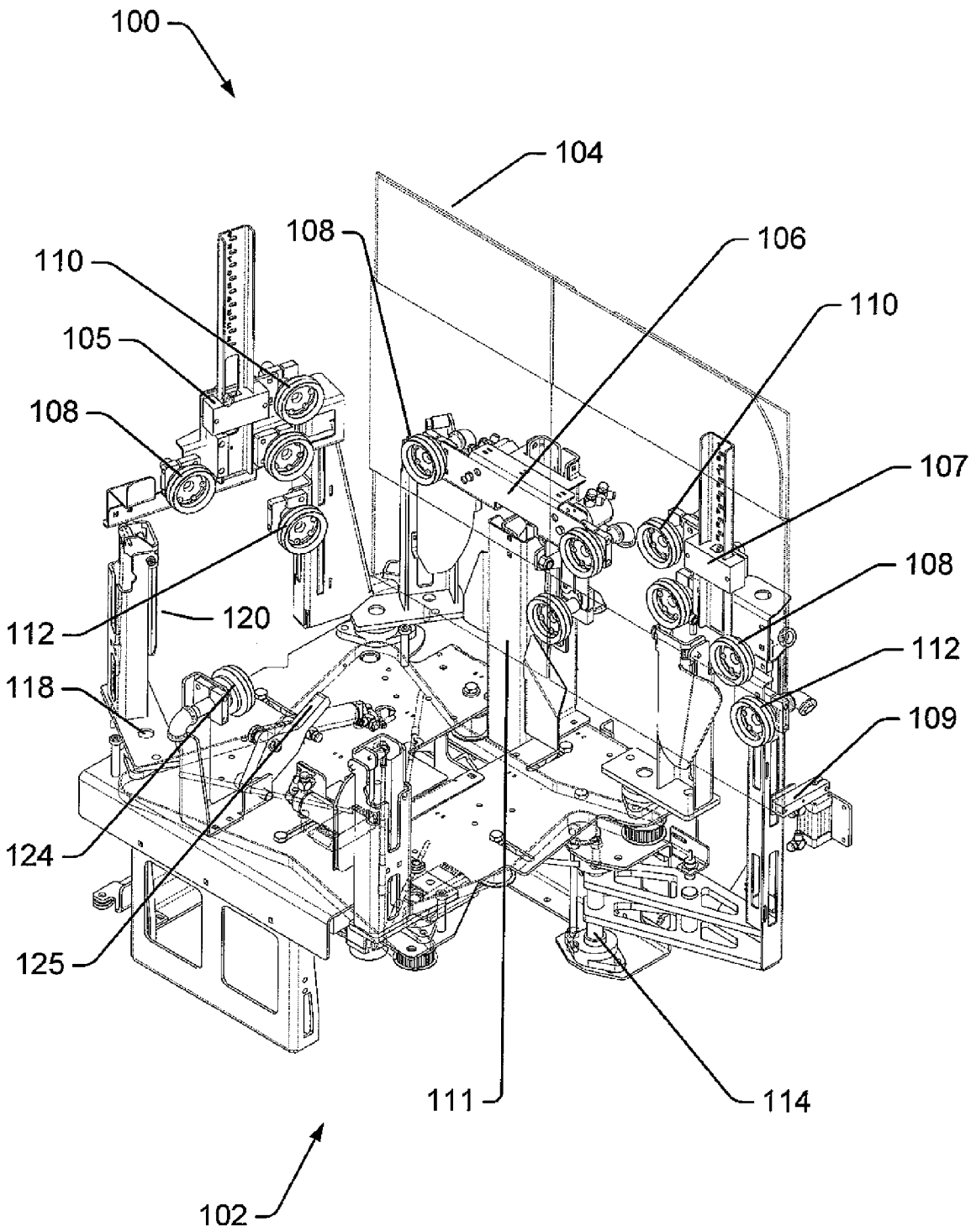
FIG. 1 illustrates a first implementation of a fan folding mechanism and a case erector, wherein a case has been received but not erected and the arms of the case-erector and the four shoes of the fan folding mechanism are in a case-receiving position. The finger associated with each shoe will be lowered when the shoe is in the case-receiving position, as seen in FIG. 1.

FIG. 1 illustrates a first example implementation of a case erector 100 having a fan folding mechanism 102. One purpose of the case erector 100 is to open a case 104 from a folded position into an open or "erected" position. "Cases," which can be cardboard boxes, are frequently sold and transported in a "knocked down" condition, for reasons of cost and convenience. The case 104 seen in FIG. 1 is in the folded configuration. In operation, the case erector 100 takes a folded case, opens it, and thereby creates an "erected" case. Examples of a case 104 in a "knocked down state" are seen in FIGS. 1 and 2, while examples of a case in an "erected state" are seen in FIG. 3 and others.

In the example implementation of FIG. 1, the case erector 100 includes (among other things) three case-erecting arms 105, 106, 107. While three case-erecting arms are shown in the example of FIG. 1, other implementations may required a different number of arms, or substitution of analogous structure(s). The case-erecting arm 105 is configured to grasp a minor (short) side of the case and to pivot 90 degrees, thereby moving the grasped side from the position seen in FIG. 2 to the position seen in FIG. 4. The case-erecting arm 106 is configured to grasp the major (long) side of the case and to essentially maintain its position as the other sides of the case are moved. The case-erecting arm 107 is configured to grasp the minor side opposite from the side associated with arm 105. Once grasped, the arm 107 pivots through 90 degrees, thereby moving the grasped side from the position seen in FIG. 2 to the position seen in FIG. 4. Note that FIG. 2 shows the case transparent for purposes of illustration, and that transparency of the case is required to make visible the arm 107 prior to movement of the minor side to the case-erected position. Each case-erecting arm in the example shown has a pair of horizontal suction cups 108 that grasp one side of the case to be erected. Suction cups 112 are illustrated as examples of trailing corner retention devices. However, a different number of suctions cups, mechanical restraining fingers or other means could be substituted as trailing corner retention devices, as needed, for any particular application. Thus, in addition to a pair of case side grasping suction cups 108, each case-erecting arm may have an upper suction cup 110 and a lower suction cup 112 to grasp upper and lower flaps of the case, respectively. The case-erecting arms 105, 107 are configured for pivotal (or similar) movement, such as about pivot 114. This movement can be seen by comparing the positions of the case-erecting arms seen in FIGS. 1 through 3. In FIG. 1, the case-erecting arms are in a preparatory, withdrawn or case-receiving position, wherein not all case-erecting arms are in contact with the case.

Figure 2:
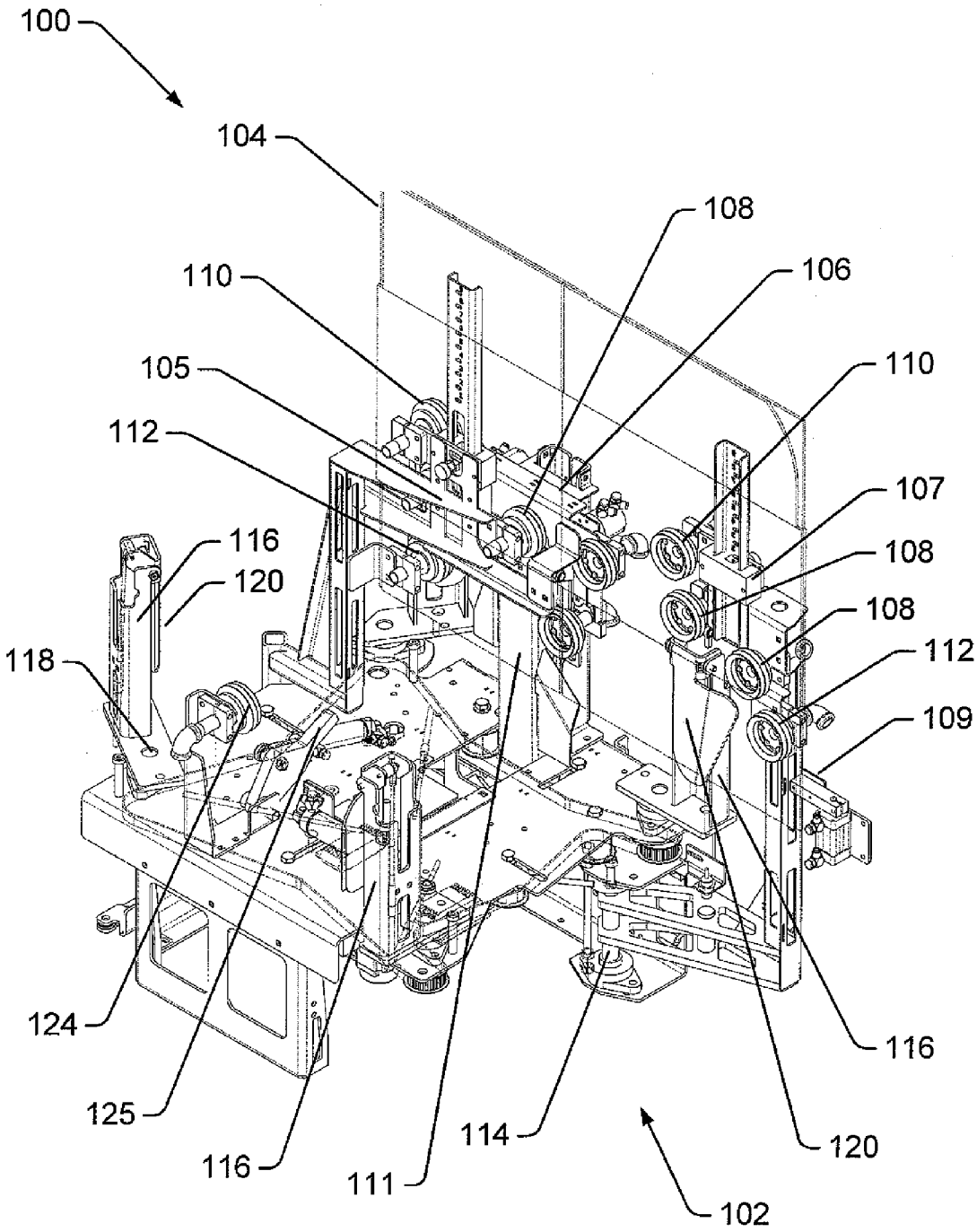
FIG. 2 illustrates the fan folding mechanism and case erector of FIG. 1, wherein the at least two sides of the case have been grasped by a pair of case-erecting arms in preparation for erection of the case.
Figure 3:
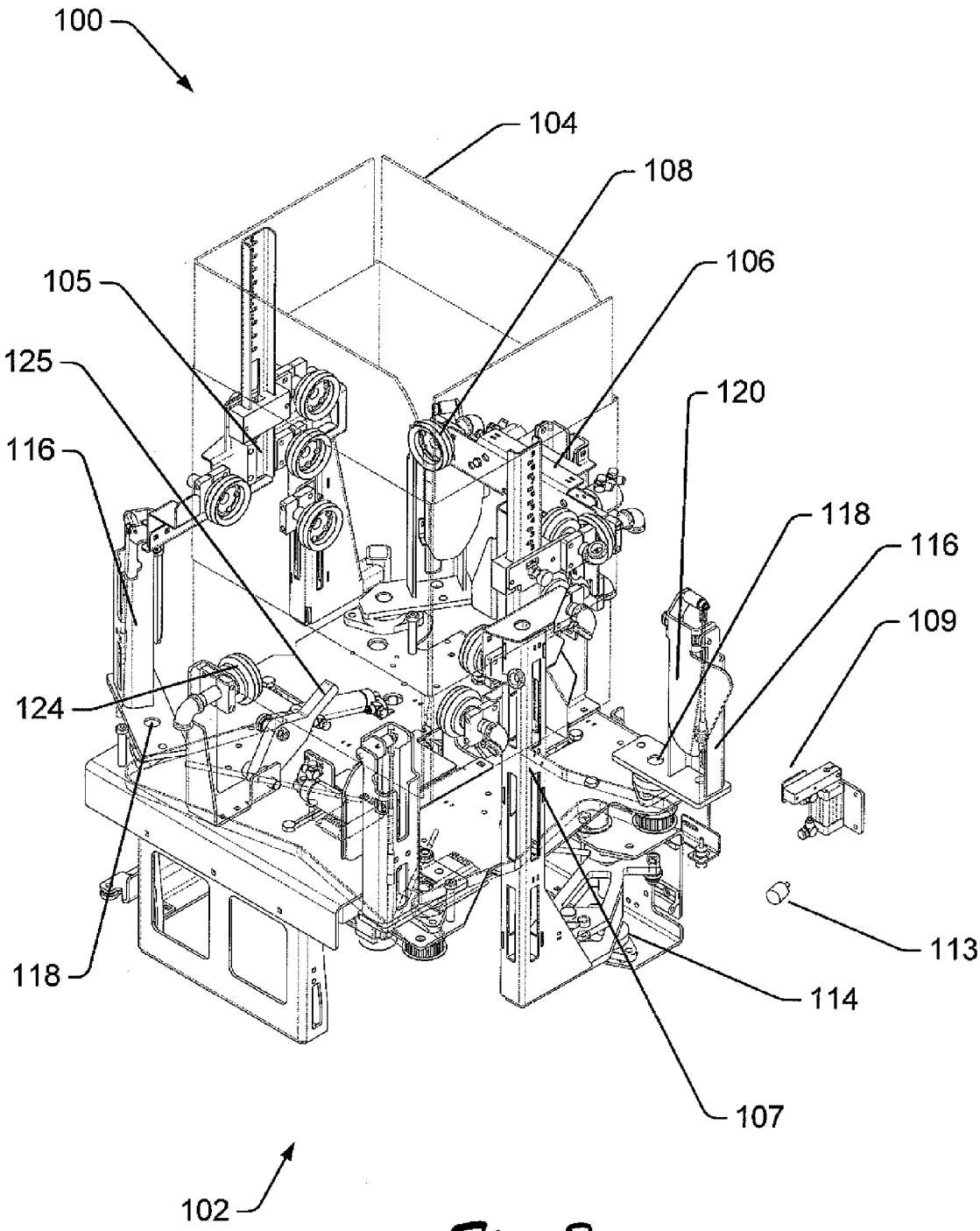
FIG. 3 illustrates the fan folding mechanism and case erector of FIG. 2, wherein motion of the case-erecting arms has fully erected the case.

A comparison of FIGS. 1 and 2 reveals that the case-erecting arm 105 pivots through approximately 90 degrees to contact the case 104. Thus, in the view of FIG. 2, the case-erecting arm 105 presses the case 104 against the major side case-erecting arm 106. Thus, the suction cups 108 associated with both case-erecting arms 105, 106 are secured to the case 104. The case 104 is affirmatively pushed against the suction cups 108 of the case-erecting arm 107 in a somewhat different manner. In particular, a case-pushing finger 109 rotates 90 degrees from a position seen in FIG. 1 to a position seen in FIG. 2. In the position seen in FIG. 2, the case-pushing finger 109 has pushed the case 104 against the suction cups 108 of the case-erecting arm 107, thereby making the connection between the cups and the case.

Figure 8:
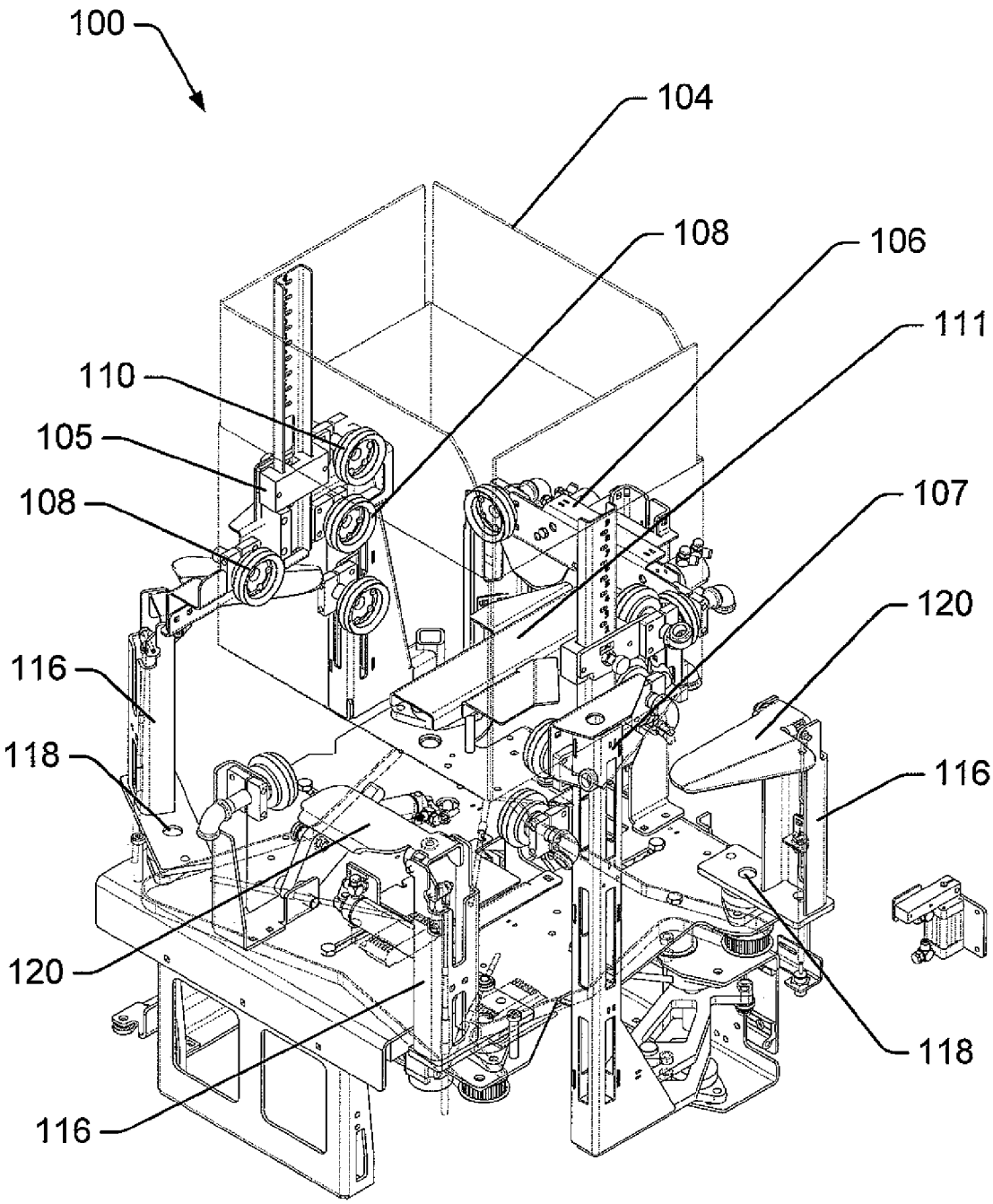
FIG. 8 illustrates the fan folding mechanism and case erector of FIG. 5, wherein four shoes, each with the flap-kicking finger still in the extended position, have been rotated, thereby locating the four shoes in the case-receiving and/or case-removal position.
Figure 9:
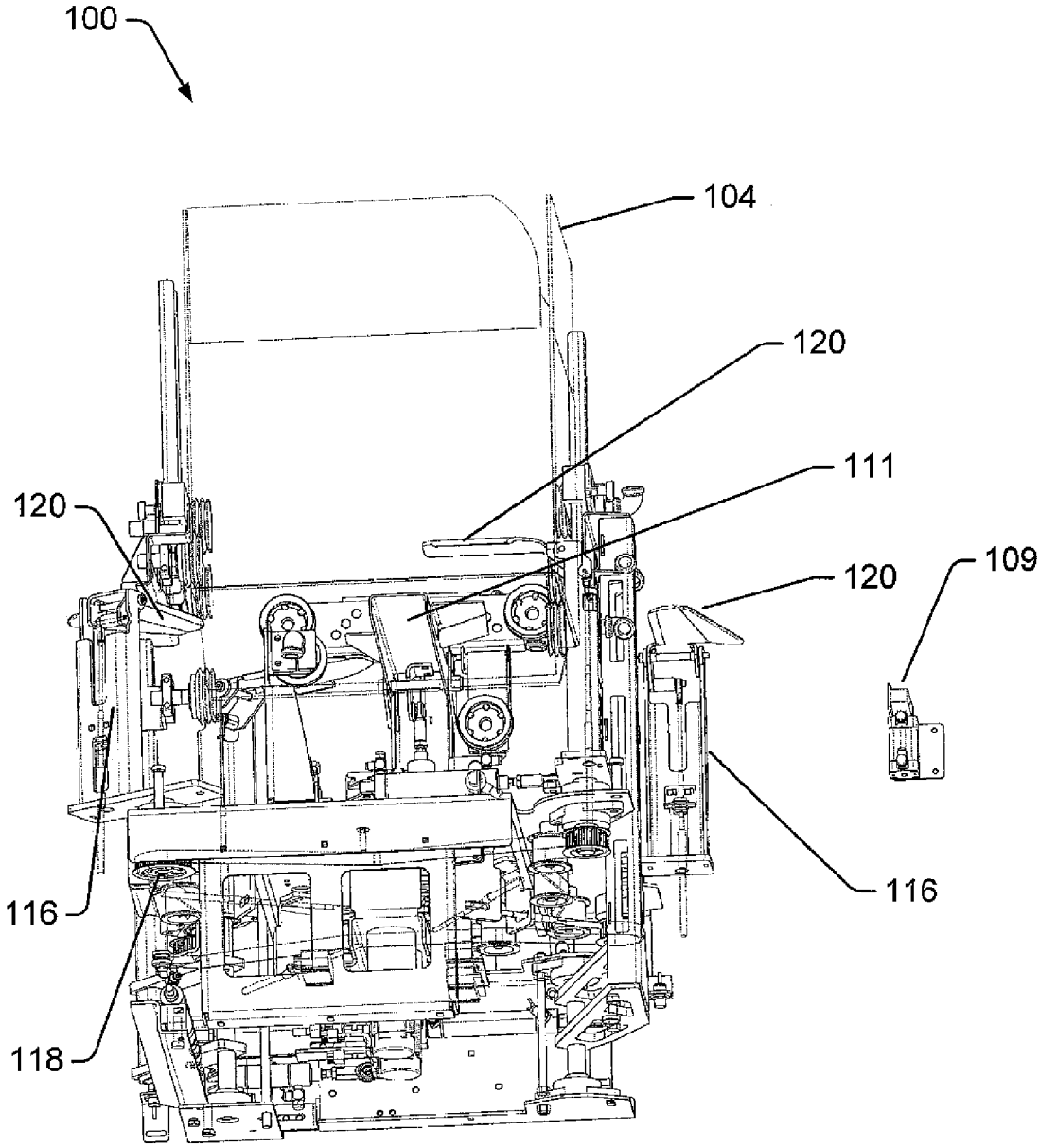
FIG. 9 illustrates an enlarged view of aspects of the fan folding mechanism for a case erector of FIG. 8.

FIGS. 1 and 2 show a view of a discharge pan 111, which forms a case-supporting bar, in a retracted state wherein the case is not being actively supported. The discharge pan 111 is configured to support a bottom surface of a case after the flaps are closed, such as by fan-folding or conventional closing and taping/gluing. Because the case is typically discharged after closing, the discharge pan 111 supports the case at discharge. In contrast to the views of FIGS. 1 and 2 wherein the discharge pan 111 is seen in the retracted state, FIGS. 8 and 9 show upper and lower views, respectively, of the discharge pan in the extended state, wherein the case is actively supported.

FIG. 2 shows a further step in the operation of the case erecting mechanism 100. In particular, the case-erecting arm 105 that was previously in a withdrawn or case-receiving position has pivoted to a point wherein it is in contact with the knocked down case, and has thereby assumed a case-contacting position. This allows the two horizontally arrayed suction cups 108 to grasp a minor (smaller) side of the case, while the upper and lower suction cups 110, 112 grasp upper and lower flaps of the case, respectively. Movement by the case-erecting arm 105 pushes the case 104 into contact with a second case-erecting arm 106, so that suction cups on both case-erecting arms 105, 106 grasp the case 104. A third case-erecting arm 107, grasping the opposite minor side, is visible because the case is illustrated transparently. When the third case-erecting arm 107 is in the position seen in FIG. 2, it is stopped from further motion by a stop 113, seen in FIG. 3. A third case-erecting arm grasping the major side between the two grasped minor sides is seen only because the case 104 has been made transparent for purposes of illustration. In the view of FIG. 2, the case-pushing finger 109 has pushed the case 104 into contact with the suction cups 108 of the case-erecting arm 107. Thus, the case-erecting arms 105, 106, 107, are in the case-contacting position assumed before erection of the case, and grasp three sides of the case 104.

A comparison of FIGS. 2 and 3 shows that rotational or pivotal motion of the case erecting arms 105, 107 about pivots 114 results in erection of the case 104. The case-erecting arm 106, which secures the major side of the case, is substantially fixed in position. A fourth side (a larger, or major side) of the case is not associated with a case erecting arm; however, this side is moved into position by virtue of its connection to other sides of the case.

FIGS. 1-3 show portions of the fan-folding apparatus 102, including four shoes 116, wherein each "shoe" is positioned in a case-receiving position or configuration. The shoes 116 are moveable from a case receiving position, seen in FIGS. 1-3, to a flap-folding position, seen in FIGS. 4-7. In the case-receiving position shown in FIGS. 1 and 2, the shoes are located in a manner that provides space for the case 104 to be received or discharged, and the finger 120 associated with each shoe is in the retracted position, i.e. folded flat against the shoe. The shoes are moved between the case-receiving position and the flap-folding position by any appropriate rotation or sliding motion. In the example of FIGS. 1-10, the shoes pivot about a shoe pivot 118 or axis a short distance from each shoe.

Figure 4:
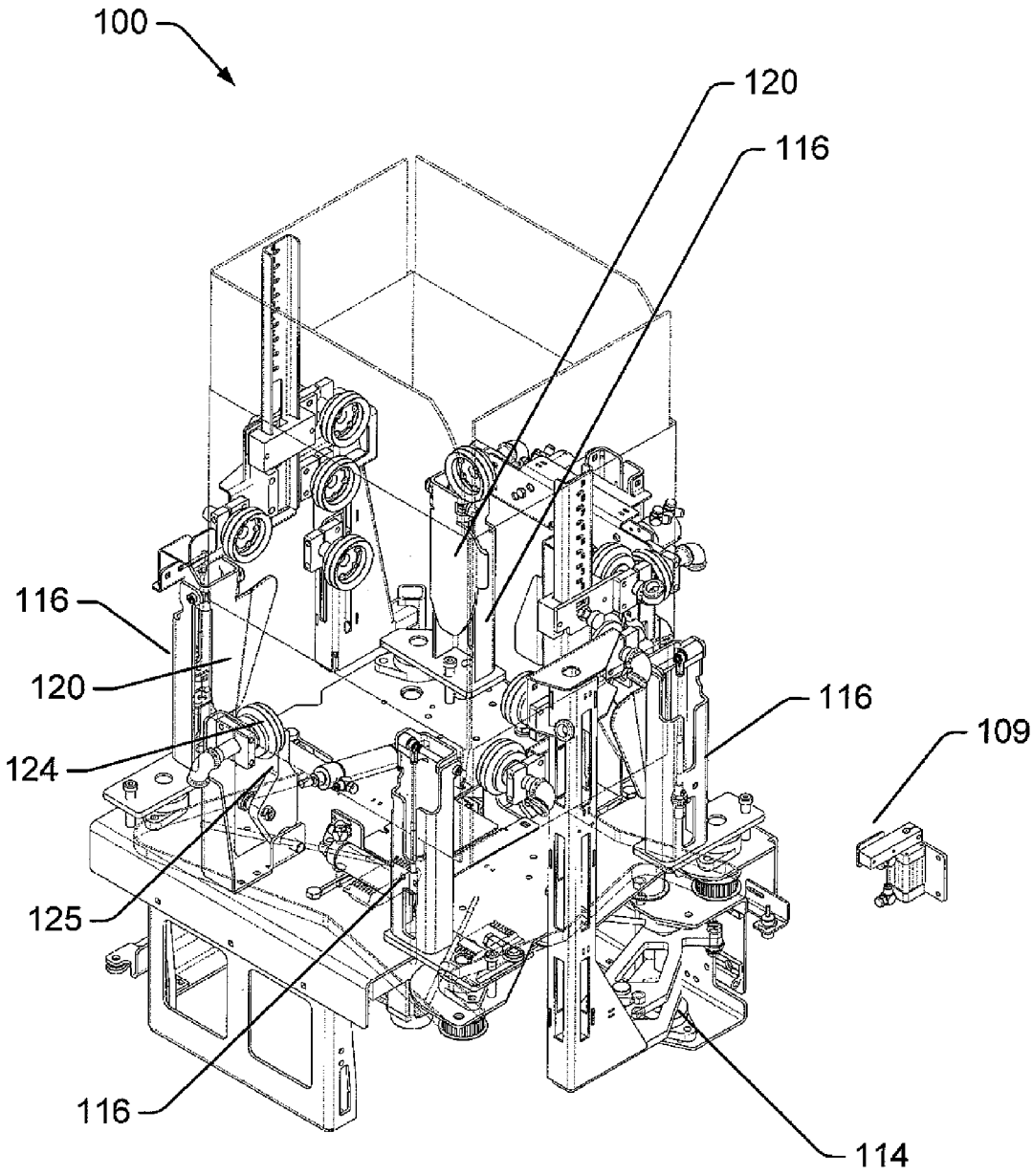
FIG. 4 illustrates the fan folding mechanism and case erector of FIG. 3, wherein the shoes have been rotated from the case-receiving position to the flap-folding position such that a finger associated with each shoe is in contact with a flap of the case to be folded.

FIG. 4 illustrates two principle advancements of the mechanism, not shown by FIG. 3. First, in FIG. 4 the shoes 116 have been pivoted from the case-receiving position to a flap-folding position, wherein a finger 120 associated with each of the four shoes is in contact with a leading corner of one of the four flaps to be fan-folded. In particular, each shoe 116 rotates about a pivot 118 between a position assumed during case-erecting (FIG. 3) and a position assumed during fan-folding (FIG. 4). The rotation puts the finger 120 into contact with the flap of the case. The finger 120 is configured for movement over approximately 90 degrees, during which range of movement the leading corner of each flap is pushed from an open position to a closed position. Thus, in operation, the finger 120 pivots to push closed a flap of the case 104 associated with the shoe and finger structure. Each of the four fingers 120, shown retracted in FIGS. 3 and 4, and extended in FIGS. 5 and 6, rotates through 90 degrees to close each of the four flaps, including the longer major flaps and the smaller minor flaps.

A comparison of FIGS. 3 and 4 also illustrates movement of a flap-pushing arm 125, which is configured to push a flap, e.g. the major flap, into contact with a suction cup 124, which is not carried by a case-erecting arm. In FIG. 3, the flap-pushing arm 125 is in an inactive position, wherein it is not actively pushing the flap. In FIG. 4, the flap-pushing arm 125 is in an active position, wherein it is pushing the major flap into the lower suction cup 112. In the example construction of FIGS. 1-10, a flap-pushing arm 125 is associated with only the one flap, since the lower suction cups 112 associated with the three case-erecting arms 106 attach to their respective flaps when the arms 105, 106, 107 are in the position seen in FIG. 2.

Figure 5:
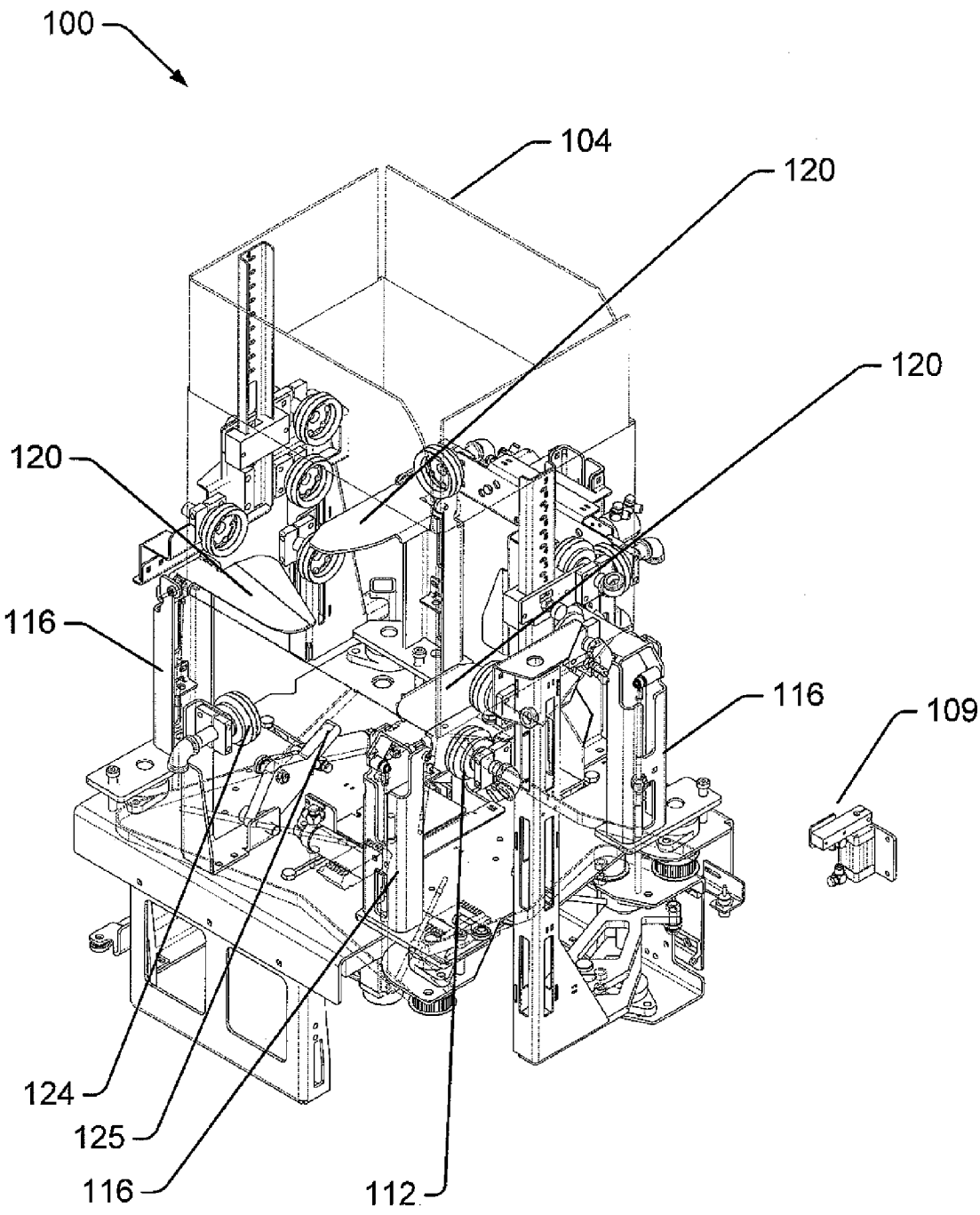
FIG. 5 illustrates the fan folding mechanism and case erector of FIG. 4, wherein the finger of each shoe has been moved from a retracted position associated with a yet-to-be-closed flap to an extended position associated with a closed flap.

In FIG. 5, the flap-pushing arm 125 retracts to the inactive position, so that it does not obstruct movement of the flap as it is closed by the fan-folding mechanism.

Continuing to refer to FIG. 5, the finger 120 of each shoe 116 has been moved from a retracted position associated with a yet-to-be-closed flap to an extended position associated with a closed flap. One finger is obscured from view. This movement results from a 90-degree rotation of each finger 120, which pushes a leading corner of each flap from the open to the closed position. Thus, FIG. 5 illustrates the case 104 with the four lower flaps closed in a fan-fold manner. Note that the side of the flap pushed by the finger 120 is the "leading corner" or "leading side" of the flap. The flap held by the lower suction cup 112 is the "trailing corner" or "trailing side" of the flap. As each finger 120 moves through a 90-degree rotation, the leading corner of one flap is closed slightly before the trailing corner of an adjacent flap.

Figure 6:
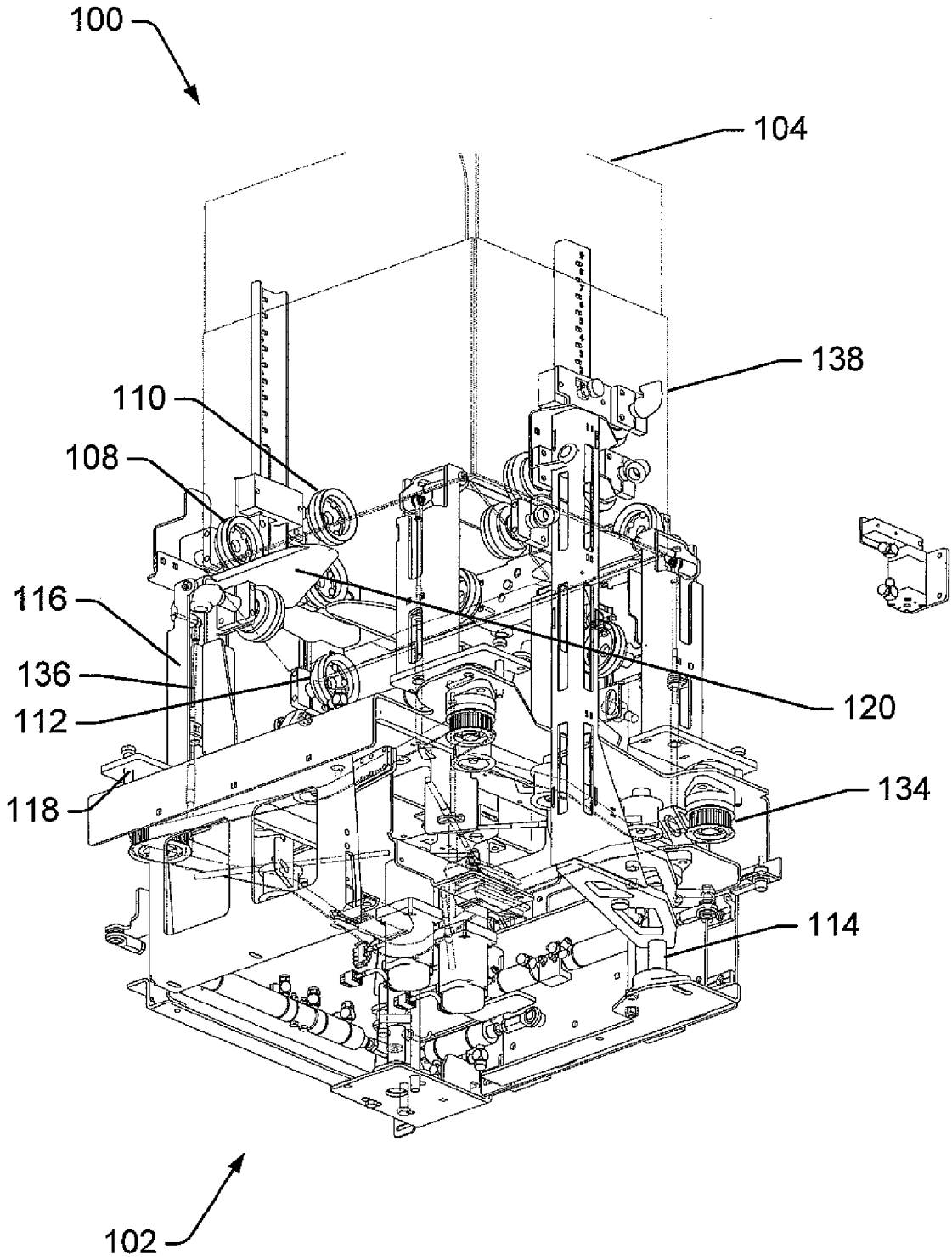
FIG. 6 illustrates the fan folding mechanism and case erector of FIG. 5 from an angle below the case.
Figure 7:
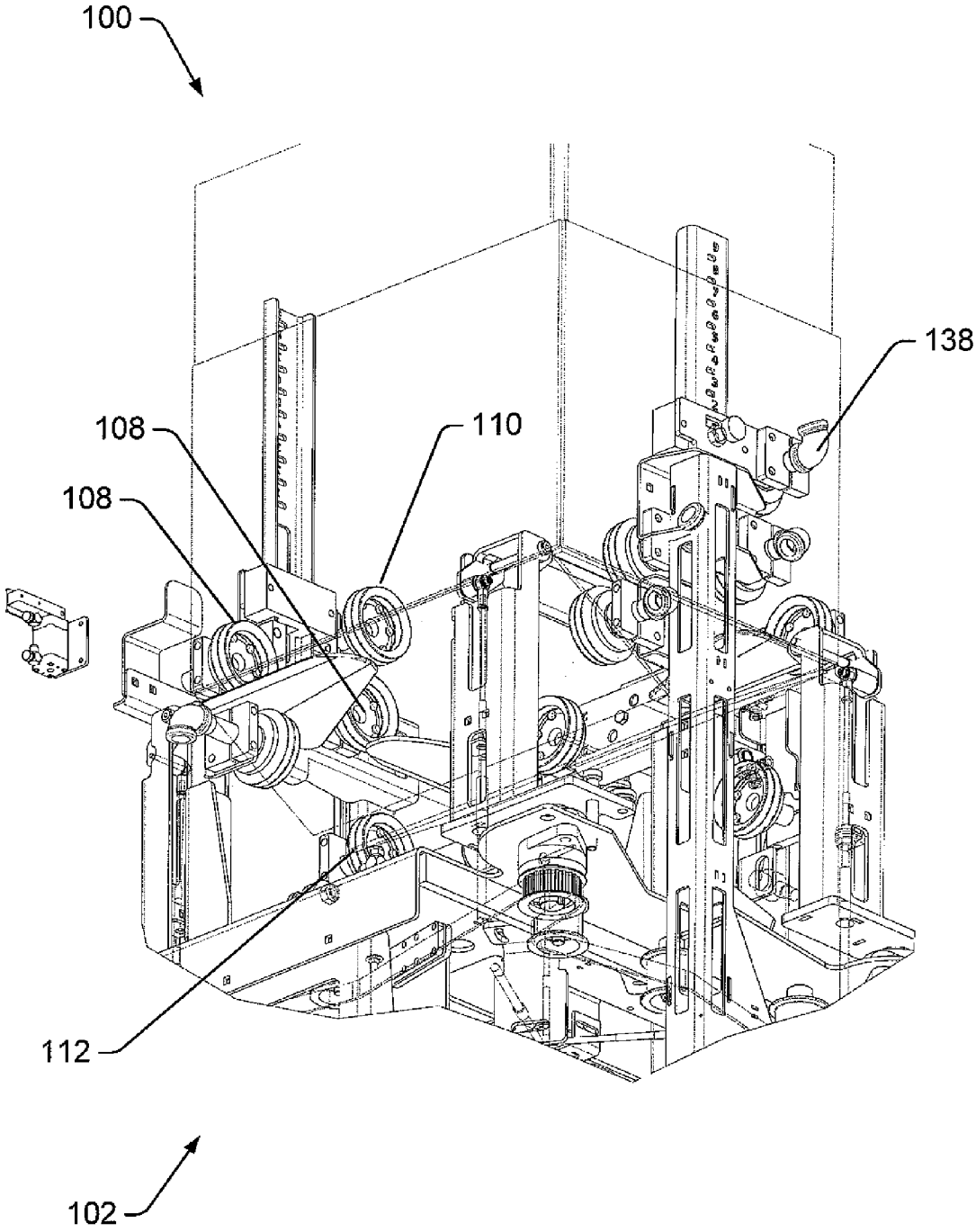
FIG. 7 illustrates an enlarged view of aspects of the fan folding mechanism and case erector of FIG. 5.

FIG. 6 illustrates the fan folding mechanism 102 from an angle below the case 104. In particular, FIG. 6 illustrates one example of how the case erecting-arms, the shoes 116 and the fingers 120 may be operated. For example, the case-erecting arms 105, 107 may be pivoted about pivots 114 by compressed air-driven cylinders. The shoes 116 may be pivoted about shoe pivots 118 by a belt- or chain-drive system 134. The fingers 120 may be extended using a compressed air cylinder 136. Each suction cup is configured for attachment to a vacuum source by threaded fittings 138. FIG. 6, and the enlarged view of FIG. 7, are meant to be provide an illustrative example of how the components discussed can be operated, but is not meant to suggest any requirement that the example shown be utilized for any and/or all applications. Thus, a number of different drive systems, such as motors or stepper motors, could be substituted for the compressed air, chain drives, belt drives and vacuum sources described in the above illustration. Moreover, any particular implementation may suggest specific structures that may be used, while keeping with the overall teachings included herein.

After extension of the flap-pushing fingers 120, which close the flaps in a fan-fold manner, the discharge pan 111 can be moved from the retracted position seen in FIGS. 1 and 2 to the case-supporting position seen in FIGS. 8 and 9. Thus, the discharge pan 111 supports the case 104 as it is discharged from the case-erector 100 after operation of the fan-folding assembly 102.

FIG. 8 illustrates rotational movement of all four shoes 116, each with the flap-kicking finger 120 still in the extended position, from the fan-folding, i.e. flap-closing, position to the case-receiving, and/or case-removing, position. While rotational movement of each shoe 116 about the shoe pivot 118 is shown, a sliding or retracting motion can be substituted, if an application suggests. Note that, upon closing the flaps, each finger 120 is located between the leading corner of one flap and the trailing corner of an adjacent flap. Accordingly, by leaving the fingers 120 in the extended configuration during rotation of the shoes, the fingers slide away from the case 104 without further movement of the flaps.

FIG. 9 illustrates an enlarged view of aspects of the fan folding mechanism for a case erector of FIG. 8.

Figure 10:
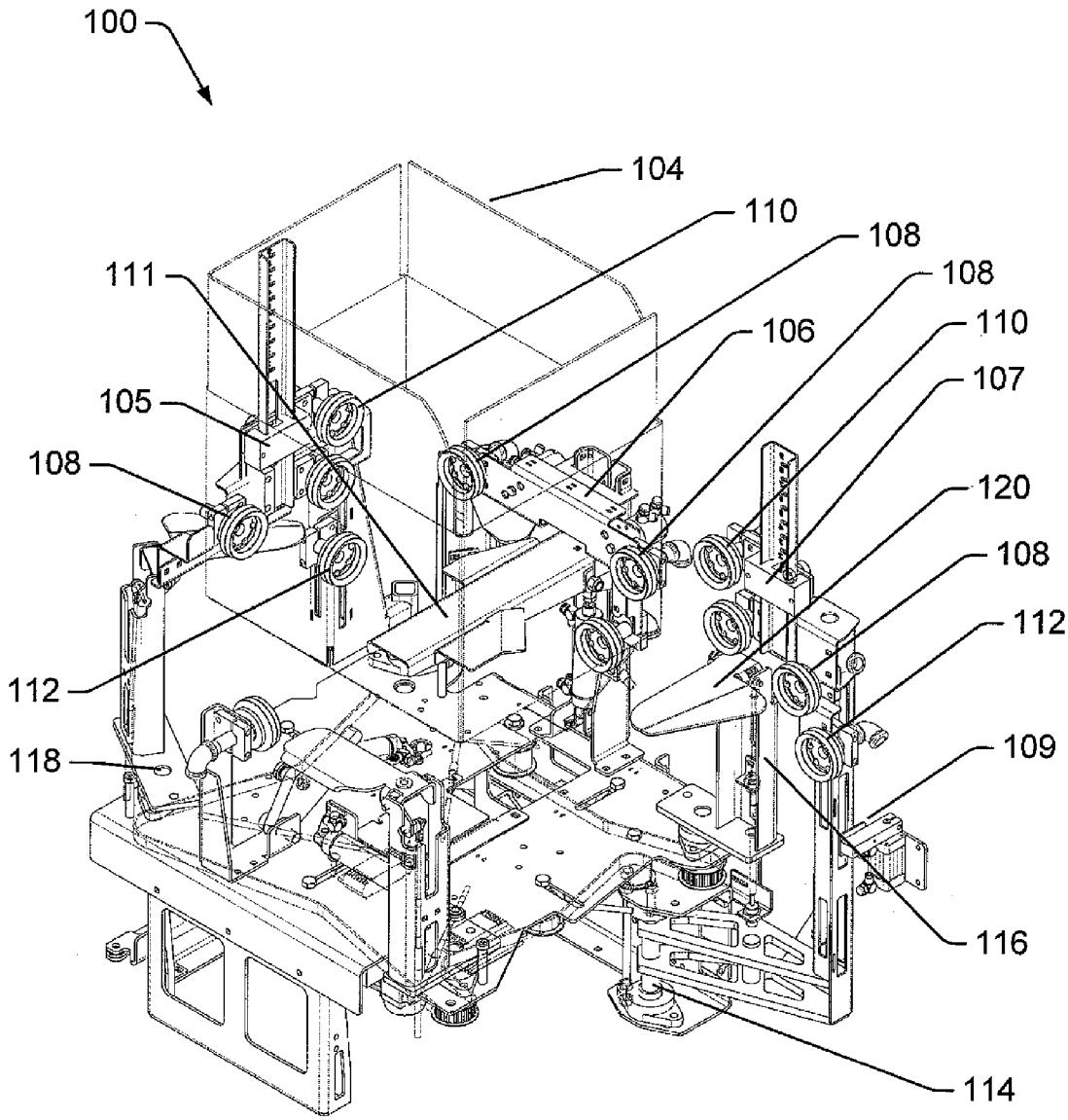
FIG. 10 illustrates the fan folding mechanism and case erector of FIG. 8, wherein one of the case-erecting arms, shown with four suction cups, has been pivoted to allow removal of the case. In the implementation of FIGS. 1-10, both case-erecting arms associated with minor (small) panels (of the rectangular case) are configured to open, either for admitting a new case or for release of an erected case.

FIG. 10 illustrates the fan folding mechanism for a case erector of FIG. 8, wherein one of the case-erecting arms 105, 106, 107 shown with four suction cups 108, 110, 112, has been pivoted to allow removal of the case 104. Note that how many case-erecting arms rotate to allow the erected case having fan-folded lower flaps to be removed depends in large measure on where the case is going and other aspects of the particular application. Accordingly, some variation could be expected, as required.

Second Example Implementation

Figure 11:
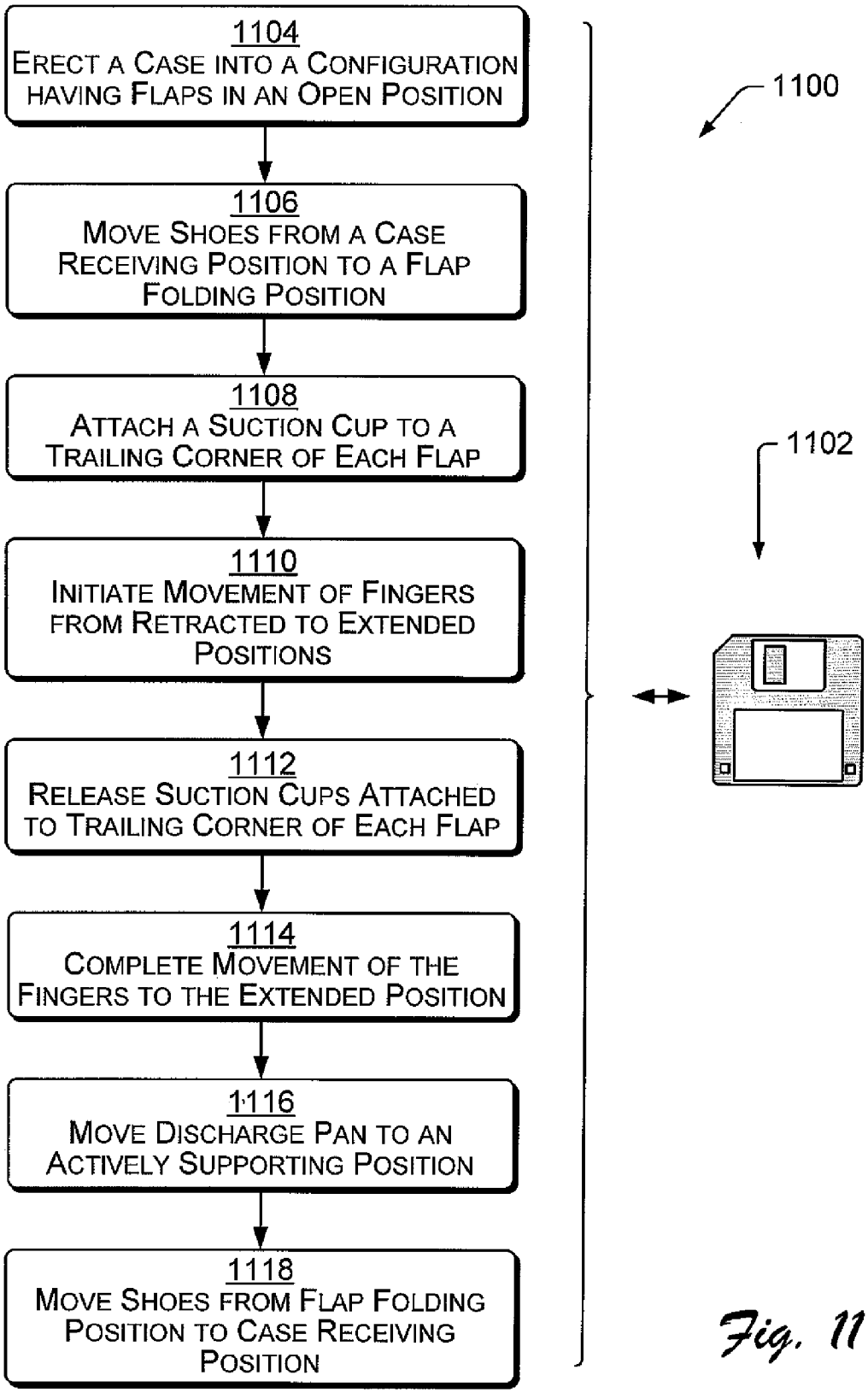
FIG. 11 illustrates, by means of a flowchart, a second implementation of a fan-folding mechanism for a case erector.

FIG. 11 illustrates, by means of a flowchart, a second implementation 1100 of a fan folding mechanism for a case erector. Because the mechanical operation of various component parts discussed can be controlled by operation of computer software and/or processor executed statements, such as by operation of an electrically-based control system, portions of the second implementation, as discussed herein, can be defined on a computer and/or processor readable media 1102.

For example, a computer program can be used as a part of a control system to govern the operation of various mechanical parts, and that the computer program can be defined on the computer readable media 1102.

At block 1104, a case is erected into a configuration having flaps in an open position. For example, a cardboard box in a "knocked down" configuration is erected into a three-dimensional configuration with the upper and lower flaps (i.e. the top and bottom of the box) in the open position. An example of the knocked down configuration is seen in FIGS. 1 and 2, while the erected configuration with flaps in an open position is seen in FIGS. 3 and 4.

At block 1106, shoes are moved from a case-receiving position to a flap-folding position. Refer to FIGS. 3 and 4 to see one example of this movement. In FIG. 3, the shoes 116 are in the case-receiving position, which allows the case to be moved into position within the case erector 100, without contention, collision or interference with the shoes. Once the case is erected, the shoes 116 pivot about shoe pivots 118 into the flap-folding position shown by FIG. 4. Thus, in one example, the four shoes move by pivoting each shoe about an axis a short distance from that shoe. In the flap-folding position, the shoes 116 are positioned to locate the finger 120 associated with each shoe against one side of each of four flaps.

At block 1108, a trailing corner retention device, such as a suction cup, is attached to a trailing corner of each flap. Refer to FIGS. 2 and 4 to see two example implementations of suction cup attachment. FIG. 2 shows that lower suction cups 112 can be attached to flaps to be fan-folded by movement of case erecting arms 105, 106, 107. In particular, rotation of a case-erecting arm about a pivot 114 can press a suction cup 112 against a trailing corner of a flap. In an alternative structure, FIG. 4 shows that a flap-pushing arm 125 can be used to press the trailing corner of a flap into contact with a suction cup 112. Thus, at least two example implementations of block 1108 are specifically illustrated, and others can be envisioned.

At block 1110, movement of fingers from a retracted to an extended position is initiated. In one example, movement of fingers 120 associated with each shoe 116 begins to push the leading corner of each flap into the closed position. Note that movement of all of the fingers from the retracted to the extended position may or may not happen at the same time. That is, the mechanism provided to close the flaps of the case may not start to close, or close, each of the flaps at the same time. In particular, initiation of movement of one or more fingers may be deliberately delayed until after initiation of movement of other fingers. By initiating movement of one or more flaps (pushed, for example, by one or more fingers), before the movement of one or more other flaps, contention between adjacent flaps may be eliminated. Friction, collision, binding or other contention may result when two adjacent flaps are closed at the same time. To avoid this, movement of fingers of opposed shoes associated with major flaps may be initiated before movement of fingers associated with minor flaps. Alternatively, movement of fingers of opposed shoes associated with minor flaps may be initiated before movement of fingers associated with major flaps. And still further, the timing of movement by each finger may be adjusted as needed, due to the size, flexibility, age (and other factors) of the cases being fan-folded. For example, boxes with warped flaps may be more successfully fan-folded if there is a greater elapsed time between movement of the different fingers 120.

At block 1112, trailing corner retention devices attached to the trailing corner of each flap are released (e.g. the suction cup releases the flap to which it is attached). In one example of the release of the suction cups, all suction cups can be released at the same time. In a second example of the release of the suction cups, the suction cup attached to the trailing corner of each minor flap is released before the suction cup attached to the trailing corner of each major flap is released. In a third example of the release of the suction cups, the suction cup attached to the trailing corner of each major flap is released before the suction cup attached to the trailing corner of each minor flap is released. In a further example, mechanical arms may be used in place of the suction cups. These examples of staggered release of the trailing corner retention devices are representative of factors used to control—and eliminate—contention between adjacent flaps.

At block 1114, movement of the fingers to the extended position is completed. Referring and comparing FIGS. 4 and 5, it can be seen that the flaps of the box are close when movement of the fingers 120 to the fully extended position is completed.

At block 1116, the discharge pan 111 is moved into a position actively supporting the bottom of the erected and fan-folded case 104. The discharge pan 111 is seen in the retracted position in FIGS. 1 and 2, and the extended position, supporting the case 104, in FIGS. 8-10.

At block 1118, the shoes are moved from the flap-folding position to the case-receiving position. An example of this movement can be seen by examining FIGS. 5 and 8. In FIG. 5, the shoes 116 are in the flap-folding position, and the finger 120 associated with each shoe is in the extended position. The shoes 116 rotate about their shoe pivots 118, and assume the case-receiving position seen in FIG. 8. Note that in most applications, the fingers 120 will move to the retracted position after rotation of the shoes, and before a further case is received. Thus, the example of FIG. 11 can be repeated.

Third Example Implementation

Figure 12:
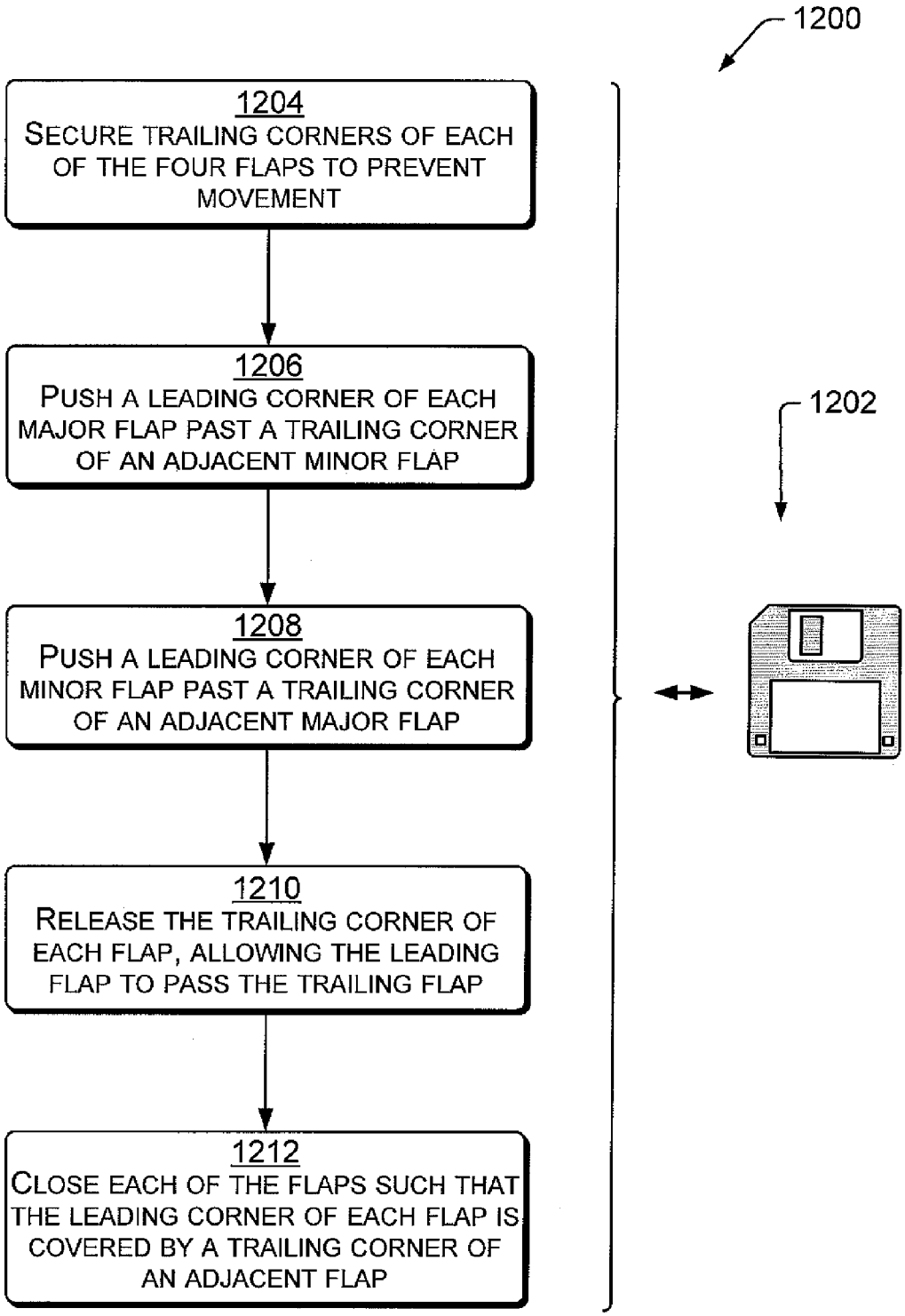
FIG. 12 illustrates, by means of a flowchart, a third implementation of a fan-folding mechanism for a case erector.

FIG. 12 illustrates, by means of a flowchart, a third implementation 1200 of the fan-folding mechanism for a case erector. As in the implementation 1100, a computer-readable media 1202 may be used to control movement of some or all of the mechanical parts discussed and/or described herein.

At block 1204, trailing corners of each of the four flaps are secured to prevent movement. The trailing corners may be secured by suction cups, mechanical arms or other structure, as indicated by a particular application. As discussed with respect to FIGS. 2 and 4, the trailing corners of one or more flaps may be secured to prevent movement prior to erection of the case. For example, FIG. 2 shows that the suction cups 112 of the case-erecting arms 105, 106, 107 are secured to the flaps prior to erection of the case. In contrast, the trailing corners of one or more flaps may be secured to prevent movement after erection of the case. For example, FIG. 4 shows that arm 125 moves a flap of the case into contact with the suction cup 124 after erection of the case. Thus, the trailing corners of the flaps may be secured to prevent contention as the flaps are closed, and the securing may be performed either before or after the case is erected.

At block 1206, a leading corner of each major flap is pushed past a trailing corner of an adjacent minor flap, while at block 1208, a leading corner of each minor flap is pushed past a trailing corner of an adjacent major flap. The pushing of flaps in blocks 1206/1208 can be performed in any order and in any manner that avoids contention between the leading corners and the trailing corners. In part, contention is avoided by applying some warping to the flaps, thereby allowing the leading corner of one flap to pass the trailing corner of an adjacent flap. For example, the fact that the finger of each shoe applies force to one side of the flap (the leading corner) results some deformation or bending of the flap. In one application, pushing the leading corner of the major and minor flaps is performed by inducing a delay, between initiation of pushing the leading corner of each major flap and initiation of pushing the leading corner of each minor flap, comprising a 5 to 50-millisecond period. While this period is generally applicable, use of a delay outside this range may be required for particular applications.

At block 1210, the trailing corner of each of the four flaps is released. The particulars of the releasing depend entirely on the application, and more particularly, on what structure was used to secure the trailing corners of each flap. For example, where a suction cup was used to secure the trailing flaps, releasing the trailing corners could be accomplished by releasing a vacuum (or partial vacuum) used by the suction cup to retain and secure the trailing corner. Where a mechanical arm was used, releasing the trailing corner would typically involve moving that arm.

At block 1212, each of the flaps is closed such that the leading corner of each flap is covered by the trailing corner of an adjacent flap. The closing each of the flaps can be performed by moving a mechanically operated finger 120 over a 90-degree course, wherein each flap is closed by application of force to the leading corner as seen in FIGS. 1-10.

While the second and third implementations of the fan-folding apparatus have been disclosed by means of flow diagrams and text associated with the blocks of the flow diagrams, it is to be understood that the blocks do not necessarily have to be performed in the order in which they were presented, and that an alternative order may result in similar advantages. Furthermore, the methods are not exclusive and can be performed alone or in combination with one another.

Conclusion

Although aspects of this disclosure include language specifically describing structural and/or methodological features of preferred embodiments, it is to be understood that the appended claims are not limited to the specific features or acts described. Rather, the specific features and acts are disclosed only as exemplary implementations, and are representative of more general concepts. For example, while the above discussion has shown a case 104 having a rectangular configuration, the same teachings could be applied to a case having a square construction, or wherein the roles of major and minor case sides were reversed. Additionally, while the fan-folding assembly was described for fan-folding the flaps of a case, it could also be used for conventional folding (closing of both minor flaps followed by closing of both major flaps), followed by application of tape and/or glue.

The invention claimed is:

1. A method of closing a case having four flaps to result in a fan fold configuration, each of the four flaps comprising a leading corner and a trailing corner, the method comprising:

providing four shoes, each of the shoes comprising:

a finger defining a contact surface;

a first axis about which the shoe, including the finger, is pivotable; and a second axis about which the finger is pivotable relative to its shoe, the second axis being perpendicular to the first axis;

placing the four shoes in a case receiving position in which:

each of the fingers is in a retracted position in which the contact surface of the finger is parallel to the respective first axis and perpendicular to the respective second axis; and the shoes are located so that the contact surfaces of the fingers are not in contact with respective ones of the leading corners of the flaps when the case is in an open position in which each flap is secured and oriented perpendicular to two adjacent flaps and parallel to another of the flaps;

securing the respective trailing corners of the four flaps to place the flaps in the open position in which each flap is secured and oriented perpendicular to two adjacent flaps and parallel to another of the flaps;

pivoting the four shoes about their respective first axes to thereby place the four shoes in a flap folding position in which:

each of the fingers is in the retracted position in which the contact surface of the finger is parallel to the respective first axis and perpendicular to the respective second axis; and the shoes are located so that the contact surfaces of the fingers are in contact with the respective ones of the leading corners of the flaps when the case is in the open position in which each flap is secured and oriented perpendicular to two adjacent flaps and parallel to another of the flaps;

after pivoting the four shoes about their respective first axes to thereby place the four shoes in the flap folding position, pivoting the fingers relative to their respective shoes and about respective ones of the second axes to thereby push the leading corners of the flaps;

releasing the trailing corner of each of the four flaps, wherein the releasing is timed to allow the leading corner of each flap to pass the trailing corner of an adjacent one of the flaps during pivoting the fingers relative to their respective shoes and about the respective ones of the second axes; and closing each of the flaps such that the leading corner of each flap is covered by the trailing corner of the adjacent one of the flaps to result in the fan fold configuration, comprising:

continuing to pivot the fingers relative to their respective shoes and about the respective ones of the second axes until each of the fingers is placed in an extended position in which:

the finger is oriented 90 degrees from its orientation in its retracted position; and the contact surface of the finger is perpendicular to the respective first axis and parallel to the respective second axis.

2. The method of claim 1 further comprising:

after closing each of the flaps such that the leading corner of each flap is covered by the trailing corner of the adjacent one of the flaps to result in the fan fold configuration, pivoting the four shoes about their respective first axes to thereby place the four shoes in a case removing position in which:

each of the fingers is in the extended position in which the finger is oriented 90 degrees from its orientation in its retracted position, and the contact surface of the finger is perpendicular to the respective first axis and parallel to the respective second axis; and the shoes are located so that the contact surfaces of the fingers are not in contact with the respective ones of the leading corners of the flaps when the case is in the fan fold configuration.

3. The method of claim 1 wherein the four flaps comprise two major flaps and two minor flaps;

wherein the two major flaps are spaced in a parallel relation when the case is in the open position in which each flap is secured and oriented perpendicular to two adjacent flaps and parallel to another of the flaps;

wherein the two minor flaps are spaced in a parallel relation when the case is in the open position in which each flap is secured and oriented perpendicular to two adjacent flaps and parallel to another of the flaps; and wherein pivoting the fingers relative to their respective shoes and about the respective ones of the second axes comprises:

initiating pivoting the fingers that define the contact surfaces that are in contact with the leading corners of the major flaps when the shoes are in the flap folding position;

initiating pivoting the fingers that define the contact surfaces that are in contact with the leading corners of the minor flaps when the shoes are in the flap folding position; and inducing a delay between the initiating steps, the delay comprising a 5 to 50-millisecond period.

4. The method of claim 1 wherein the case comprises four sides from which the four flaps extend, respectively; and wherein the method further comprises:

erecting the case so that each of the sides is oriented perpendicular to two adjacent sides and parallel to another of the sides, comprising:

grasping at least two sides with suction cups.

5. The method of claim 4 wherein securing the respective trailing corners of the four flaps to place the flaps in the open position in which each flap is secured and oriented perpendicular to two adjacent flaps and parallel to another of the flaps comprises:

securing one or more of the flaps to suction cups before erecting the case; and securing one or more of the flaps to suction cups after erecting the case.

6. The method of claim 1 wherein the four flaps comprise two major flaps and two minor flaps;

wherein securing the respective trailing corners of the four flaps to place the flaps in the open position in which each flap is secured and oriented perpendicular to two adjacent flaps and parallel to another of the flaps comprises attaching a suction cup to each of the trailing corners; and wherein releasing the trailing corner of each of the four flaps comprises one of the following:

releasing all of the suction cups attached to the trailing corners simultaneously; and releasing the suction cup attached to the trailing corner of each minor flap before releasing the suction cup attached to the trailing corner of each major flap.

7. The method of claim 1 wherein the four flaps comprise two major flaps and two minor flaps;

wherein the two major flaps are spaced in a parallel relation when the case is in the open position in which each flap is secured and oriented perpendicular to two adjacent flaps and parallel to another of the flaps;

wherein the two minor flaps are spaced in a parallel relation when the case is in the open position in which each flap is secured and oriented perpendicular to two adjacent flaps and parallel to another of the flaps; and wherein pivoting the fingers relative to their respective shoes and about the respective ones of the second axes comprises:

initiating pivoting the fingers that define the contact surfaces that are in contact with the leading corners of the major flaps when the shoes are in the flap folding position; and after initiating pivoting the fingers that define the contact surfaces that are in contact with the leading corners of the major flaps when the shoes are in the flap folding position, initiating pivoting the fingers that define the contact surfaces that are in contact with the leading corners of the minor flaps when the shoes are in the flap folding position.

8. The method of claim 1 wherein releasing the trailing corner of each of the four flaps comprises releasing vacuum to a suction cup.

* * * * *